United States Patent [19]

Schirneker

[11] 4,024,819

[45] May 24, 1977

[54] CARTRIDGE FOR FIREARMS

[76] Inventor: Hans-Ludwig Schirneker, Engelslit 10, Mohnesee-Vollinghausen, Germany

[22] Filed: Apr. 14, 1975

[21] Appl. No.: 567,834

[30] Foreign Application Priority Data

Apr. 13, 1974 Germany ..... 2418049

[52] U.S. Cl. ..... 102/38; 102/92.2; 102/92.4

[51] Int. Cl.[2] ..... F42B 5/02

[58] Field of Search ..... 102/38 R, 92.4, 92.2

[56] References Cited

UNITED STATES PATENTS

| | | | |
|---|---|---|---|
| 911,430 | 2/1909 | Naglo | 102/92.4 |
| 2,303,449 | 12/1942 | Fleischmann | 102/92.2 |
| 2,644,364 | 7/1953 | Nass | 102/38 X |
| 2,865,126 | 12/1958 | Dardick | 102/38 X |
| 2,866,412 | 12/1958 | Meyer et al. | 102/38 |
| 2,996,988 | 8/1961 | Kunz | 102/38 |
| 3,009,394 | 11/1961 | Kamp et al. | 102/38 X |
| 3,616,752 | 11/1971 | Lahey et al. | 102/38 |
| R4,491 | 8/1871 | Berdan | 102/38 |

*Primary Examiner*—David H. Brown

[57] ABSTRACT

A firearm cartridge is provided with a thin-wall tubular casing which carries a percussion element at its rear end and which exhibits a radially inwardly bent flange on its front end. A projectile is supported in the forward portion of the case by means of a bushing having an inwardly and forwardly extending taper that terminates in engagement with the flange of the casing. The inner periphery of the bushing exhibits an outwardly directed projection intermediate its ends, such projection being received in a mating annular recess on the outer periphery of the projectile.

2 Claims, 6 Drawing Figures

CARTRIDGE FOR FIREARMS

BACKGROUND OF THE INVENTION

The invention relates to firearms of the type provided with a barrel, a cartridge chamber normally disposed behind the barrel, and a cartridge firing means acting on the rear end of the cartridge to be fired. The invention also relates to cartridges suitable for use in such firearms.

Some types of firearms such as sub-machine guns employ a so-called mass breech block, i.e. a breech block which ideally remains closed solely by reason of its mass without the intervention of any locking mechanism until the projectile has left the barrel. In such known types of breech blocks, however, a slight premature opening movement of the breech inevitably occurs, which opening must be kept as small as possible (for high efficiency of fire power) by selecting a relatively large mass for the block. Since, on the one hand, the block mass should be as large as possible for efficiency purposes, and on the other hand, the largest practical mass is determined by the overall weight considerations for the piece, the overall resulting design of the weapon is deleteriously effected.

In another type of non-locking firearm, the cartridges to be fired are inserted into recesses in a drum or barrel, after which they are brought successively by the turning of the drum into the firing position. In such revolver-type pieces, the weight of the breech (i.e. the drum) is, like the sub-machine gun indicated above, also disproportionately great compared with the remainder of the firearm. Additionally, in both designs, it is difficult to ensure effective sealing between the rear end of the barrel and the front end of the cartridge in the firing position, so that a significant portion of the force of the expanding gases from the explosion are wasted.

SUMMARY OF THE INVENTION

These disadvantages are overcome by the firearm construction of the invention, in which in the closed-breech position the cartridge chamber is disposed intermediate the barrel and an abutment member secured to the barrel and having a front end situated at a fixed distance behind the barrel. The barrel-abutment assembly and the cartridge chamber are mounted for relative axial movement with respect to each other between such closed-breech position and an open-breech position in which a portion of the barrel-abutment assembly penetrates the bore of the cartridge chamber to eject a spent cartridge therefrom. A piston or collar disposed at the front portion of the weapon and secured to the movable one of the cartridge and barrel assemblies is rendered effective solely by the reactive forces generated by gases emerging from the mouth of the barrel to open the breech against the force of a biasing spring that normally maintains the breech in its closed position.

In one embodiment of the invention in which the barrel is held fixed, a piston is secured to the front end of the biasing spring, the other end of the spring being secured to the front surface of a pair of projections attached to the cartridge chamber and extending forwardly therefrom. The firing pin adapted to engage the rear end of a cartridge contained in the cartridge chamber is fixedly mounted at the rear end of the cartridge chamber. In this design, the abutment is in the form of a push rod that is provided with a slot for receiving the firing pin holder when the cartridge is moved into the open-breech position.

In another embodiment, in which the cartridge chamber is held fixed, a collar is secured to the barrel and to the front end of the biasing spring, while the other end of the spring is secured to a front end of the cartridge chamber. In this design, the firing pin is fixedly mounted at the front end of the abutment member.

The cartridge employed in such improved weapon may advantageously include a thin-walled tubular cartridge case having a dish-shaped percussion cap disposed at the rear end of the case. The projectile is supported entirely within the case forwardly of the percussion cap, and for this purpose may include an annular recess intermediate its ends, such recess cooperating with an annular projection extending inwardly from the surface of a bushing supported within the case.

BRIEF DESCRIPTION OF THE DRAWING

The invention is further set forth in the following detailed description taken in conjunction with the appended drawing, in which.

DETAILED DESCRIPTION

Figure 1:
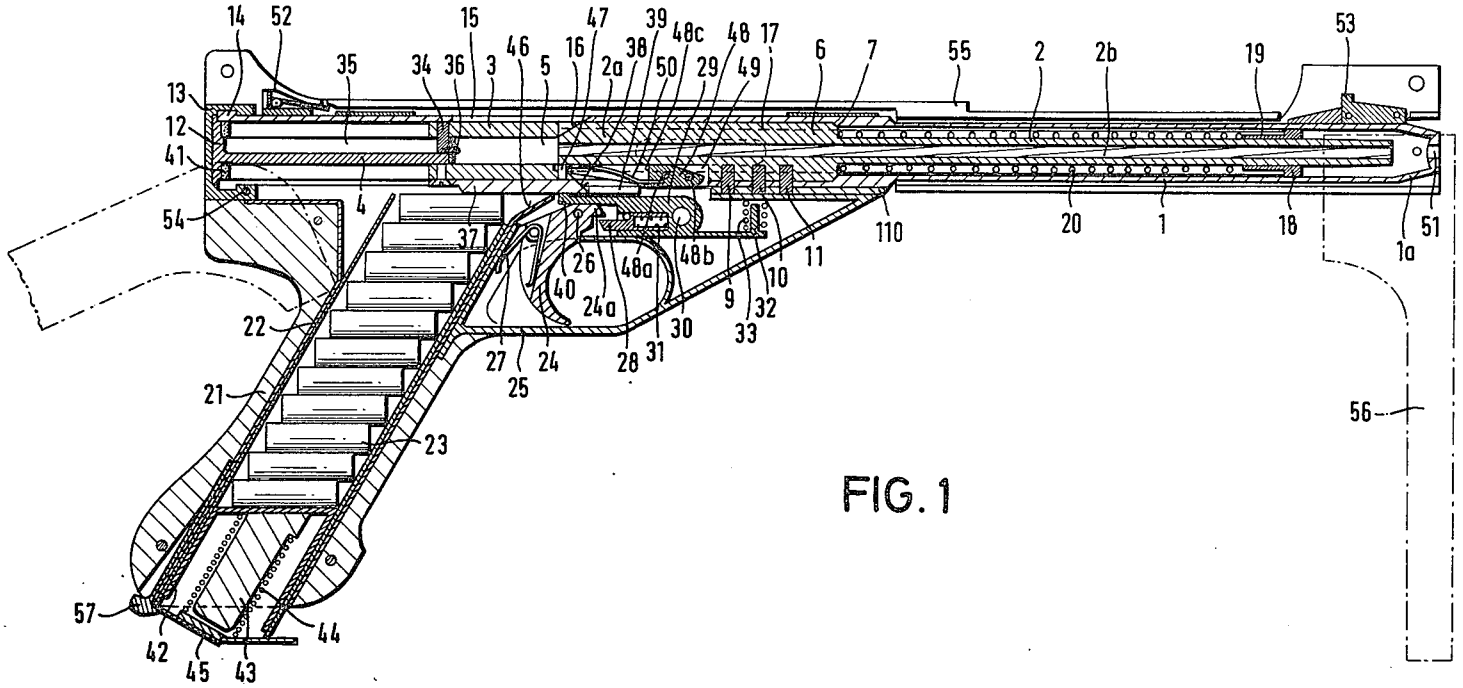
FIG. 1 is a longitudinal section through a first embodiment of the invention.

FIG. 1 illustrates a first embodiment of a firearm in the form of a sub-machine gun having a sleeve-like housing 1 extending the whole length of the piece from front to rear, a barrel 2 having a widened rear end **2*a* and a rifled bore 2*b*, a cartridge chamber 3 and a pin or push rod 4 which fits into a central bore 5 of the chamber 3. the barrel rests by an offset or widened part 6 against a shoulder 7 formed inside the housing 1 and is detachably held in this position by cotter pins 9, 10 and 11.**

The push rod 4 is provided at its rear end with a dish-shaped widened part 12 which rests against the rear end of the housing 1. The part 12 is secured with a cap 13 which can be detachably affixed to the housing 1 with a plug connection 14 for fixedly holding the push rod 4 non-displaceably in the said housing 1.

The cartridge chamber 3 is displaceable towards the rear from a closed-breech position shown in FIG. 1 to an open-breech position wherein the push rod 4 enters the bore 5 to engage a spent cartridge case present therein. For the ejection of spent cartridge cases the housing 1 has an aperture 15, underneath which is situated an oblique surface 16 on the rear end of the barrel. The surface 16 assists in the ejection of the spent cartridge case pushed upwardly by a fresh cartridge.

At the front end of the cartridge chamber 3 are two prolongations 17, only one of which is shown in FIG. 1. These prolongations 17 surround the barrel 2 forkwise, the widened rear end 2a of the barrel being flattened on opposite sides in order to provide the necessary space for the prolongations 17. The latter extend forwardly as far as a piston 18 which is displaceable on the front end of the barrel 2 and which has a bush-like guide piece 19. The piston is mounted by means of the guide piece 19 between the ends of the prolongations 17 of the cartridge chamber 3.

On the barrel 2 a helical spring 20 is mounted. The spring extends between a widened part 6 of the barrel and the guide piece 19 of the piston 18. The spring 20 biases the piston 18 into the normal front position shown in FIG. 1.

The housing 1 is connected by a connecting piece 110 with a handle 21. The handle 21 accommodates a magazine 22 secured by a wedge 57 and containing a multiplicity of cartridges 23, relatively staggered in the manner shown in FIG. 2. These cartridges are inserted individually and successively into the cartridge chamber 3, in a manner described in detail below.

A trigger 24 is also provided in the connecting piece 110. The trigger is covered by a guard bracket 25 and is pivotable about a shaft or pin 26 in opposition to the force of a spring 27. The trigger has a lug 24a which can interact with a spring-loaded slide 28 housed by a block 29 when the block has been thrust by a safety lever (not shown) into the position shown in FIG. 1. The safety lever is illustratively provided with an eccentric shaft which engages a bore 30 of the block 29 so that the block is pivotable about the axis formed by the said bore. The block 29 is positioned on the lower side of the connecting piece 110 and is likewise covered by the bracket 25.

When the block 29 is in the position shown in FIG. 1, the trigger 24, when drawn back, carries the block 29 with it and pivots it in opposition to the force of a pressure spring 33. From the position into which it has thus been moved, the trigger 24 can return over the slide 23 into the illustrated position. This is accomplished when the lug 24a thrusts the slide 28 back into the block 29, in opposition to the spring 31 acting on its rear side.

In the embodiment of FIG. 1, the cartridge chamber 3 houses a detachable holder 34 which extends into a slot 35 of the push rod 4 and carries a striker 36. The striker 36 is thus rigidly connected to the cartridge chamber 3 and, when the said cartridge chamber is disposed in its forward or closed-breech position, the striker encounters the percussion cap of a cartridge 23 in the bore 5. The required percussion force is generated by the helical spring 20. Such spring is effective to move the cartridge chamber 3, when it has been released by the trigger 24, forwardly from a rear or open-breech position into the closed-breech position shown in FIG. 1.

A slide 37 is secured to the lower side of the cartridge chamber 3 for pushing individual cartridges forwardly into a loading position and for raising them into the firing position. The slide is provided at its front end with an inclined surface 38 which extends obliquely upwardly and to the rear. The slide also has two lateral fork ends 39, only one of which is shown in the drawing. These fork ends 39 interact with the prolongation 40 of the block 29 to prevent the cartridge chamber 3 from closing (and thus prevent a cartridge from being fired) until the trigger 24 has been pressed. If the trigger 24 is drawn back in opposition to the spring 27, it will press the block 29 down via the slide 28 and in opposition to the force of the pressure spring 33. As a result the cartridge chamber 3, which has already been partly pushed over a cartridge, will be released so that the said cartridge can be fired. According to whether the firing mechanism has been set for single-shot operation or for repeated firing, the slide 37 and thus the cartridge chamber 3 will re-engage behind the prolongation 40 after each shot or after the release of the trigger 24, respectively.

After each shot, the cartridge chamber 3 moves back on the push rod 4. A disc 41 of resilient material is provided at the rear end of the said push rod 4 as a buffer stop for the rearward movement of the chamber 3.

The cartridges 23 to be introduced successively into the weapon are stored in a magazine 22. The magazine has a slide 42 which presses the cartridges upwardly under the action of a pressure spring 44 guided on a pin 43. The pressure spring 44 rests on the floor 45 of the magazine 22. If the cartridge chamber 3 is pushed back towards the left, as viewed in FIG. 1, the uppermost cartridge in the magazine 22 is pressed upwardly into the path of the slide 37. In this way, when the cartridge chamber moves into the closed-breech position, the cartridge is thrust forwardly and upwardly from the magazine over a slanting surface 46, so that the cartridge arrives at the exact spot from which it is to be fired. The front end of the cartridge here encounters a lug 47 which is provided at the lower end of the barrel and which prevents the cartridge from being pushed under the barrel.

As soon as the front end of the cartridge rests against the lug 47, the cartridge is restrained against forward thrust and the rear end of the cartridge is cammed upwardly from the inclined surface 38 as the cartridge chamber and thus the slide 37 are thrust farther forwardly. The surface 38 extends as far as the lower edge of the bore 5 of the cartridge chamber 3, and comes into alignment with the said bore 5 and the cartridge chamber as it moves onto the cartridge. The front end of the cartridge is raised by means of a lever 48, which rests in a slot 49 on the rear end 2a of the barrel 2 and is pressed down by a spring 50 in a slot of the lever. The lever 48, which is operated by means of a cam (not shown) and scanned by a pin 48b, is pivotable about a shaft 48a in such a way that its free end 48c, on the return movement of the cartridge chamber 3, is pivoted down until it is resting on the front end of a cartridge then disposed on the surface 46. In this way, the lever raises the front end of the cartridge in the desired manner.

From FIG. 1, it will be seen that the uppermost edge of the slot 49 is aligned with the lowest point of the bore 5, thus ensuring that the lever 48 raises the front end of a cartridge synchronously with the rear end until the front end reaches the level of the said bore 5.

When the cartridge chamber 3 occupies the closed-breech position shown in FIG. 1, the end 48c of the lever 48 extends into a recess of the cartridge chamber. In other words, the lever, in its raised position, extends to a predetermined distance beyond the rear end of the barrel, so that the front end of each cartridge is held by the lever 48 until the cartridge chamber completely moves into its closed-breech position over the cartridge.

When a cartridge in the cartridge chamber 3 is fired, the powder or propulsive gases generated are effective to thrust the projectile out of the barrel 2. The housing 1 is provided in the front end 1*a* with an aperture 51 through which the projectile can exit. Only a small part of the powder gases emerging from the front end of the barrel will emerge from the actual aperture 51. The greater part of such gases, building up in the interior of the housing 1, generates a back pressure which exceeds the biasing force of the helical spring 20 and which therefore presses the piston 18 rearwardly in opposition to the force of the spring. Because of the rigid connection between the piston 18 and the cartridge chamber 3, the cartridge chamber is thrust rearwardly into its open-breech position by the piston, such movement being limited by the stop disc 41. As the cartridge chamber 3 moves rearwardly, the spent cartridge casing in the cartridge chamber 3 is held fixed by the push rod 4 and exposed, so that such spent cartridge is pushed upwardly by a fresh cartridge being fed into position and thereafter ejected via the aperture 15. The cartridge chamber then moves forwardly under the force of the biasing spring 20 and onto the next cartridge, which can then be fired.

In the arrangement of FIG. 1, a back sight 52 and a front sight 53 may be attached to the housing 1 as shown. The back sight 52 may take the form of a diopter while the front sight 53 can be made pivotable out of position to dismantle the weapon.

A metal stock 55 is mounted on the connecting piece 110 so as to be pivotable on a swivel pin 54. The stock is provided with a pivotable lever 56 which, in the position shown in FIG. 1, serves as an additional handle and also forms a shoulder rest when the shaft 55 has been pivoted back into the position shown in broken lines. This arrangement enables the embodiment of FIG. 1 to be used either as a freely held weapon or as a sub-machine gun with shoulder rest.

Figure 2:
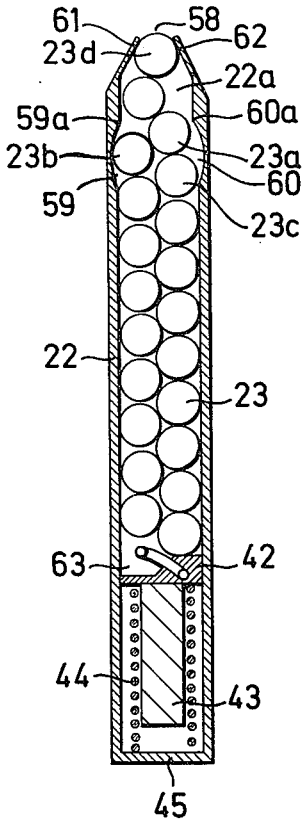
FIG. 2 is a vertical section through a magazine suitable for use in the arrangement of FIG. 1.

FIG. 2 shows an arrangement whereby the cartridges 23, arranged in two adjacent but offset rows in a loading chamber of the magazine 22, are separated from one another to emerge seriatim through an aperture 58 at the upper end of the magazine 22. In order to separate the cartridges 23, transversely opposed and aligned recesses 59 and 60 are provided near the upper end of the magazine 22, for respectively receiving the cartridges of the respective rows. This ensures that a cartridge 23*a* of one row, which below the recesses is only slightly axially offset with respect to the adjacent cartridge 23*b* of the other row, will move into position above the said cartridge 23*b*, so that the cartridges above the recesses 59 and 60 will no longer be adjacent but will be situated one above the other as shown. The cartridge 23*a* extends from the edge 60*a* of the recess 60 over the cartridge 23*b* which has moved into the recess 59, so that the cartridges can now be urged successively in the direction of the ejection aperture 58.

When the uppermost cartridge 23*d* has been ejected from the magazine 22, the slide 42 in cooperation with the inclined surfaces 38 and 46 feeds the remaining stack of cartridges upwardly so that the next cartridge 23 extends from the edge 59*a* of the recess 59 over the cartridge 23 which has moved into the recess 60.

The aperture 58 of the magazine 22 is constructed so that the rear end of the uppermost cartridge, before being expelled for the purpose of repeated fire, is positioned between inwardly extending lugs 61 and 62.

To ensure that all cartridges are extracted from the magazine, a dummy cartridge (not shown) may be hinged to the slide 42 in region 63. This dummy cartridge presses the last live cartridge in the magazine into the aperture 58 and towards the lower side of the lugs 61 and 62, from which position this cartridge can be ejected from the magazine.

In the case where the barrel 2 has a greater outer diameter than the push rod 4, there is a danger that the cartridge entering the firing chamber 3*a* when the cartridge chamber 3 moves forwardly will lie obliquely to the bore axis and will thus not be aligned with the bore 5 of the cartridge chamber. In this case, when the cartridge chamber 3 moves forwardly onto such a misaligned cartridge, the cartridge may tilt out of position in the bore 5 and thereby obstruct the loading operation.

Figure 3:
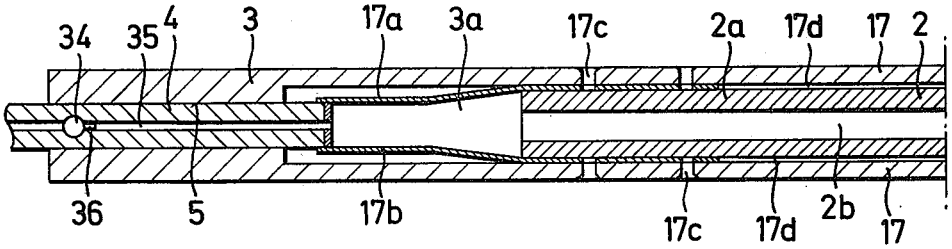
FIG. 3 is a longitudinal section through a cartridge-centering arrangement suitable for use with the arrangement of FIG. 1 when the outer diameter of the barrel is greater than the diameter of the bore of the cartridge chamber.

FIG. 3 illustrates one arrangement for avoiding this disadvantage. Flat springs 17*a* and 17*b* are respectively fixed, e.g. by rivets 17*c*, to the interior surfaces of the above-mentioned two prolongations 17 integral with the cartridge chamber 3. These flat springs are bent rearwardly and downwardly so that, when the cartridge chamber 3 is moved rearwardly into the open-breech position from the rear end 2*a* of the barrel 2, their free rearward ends will be urged against the front end of the push rod 4. Thus, when a new cartridge is ejected from the magazine, the free inbent ends of the flat springs 17*a* and 17*b* will grip this cartridge and align it accurately with the bore 5 of the chamber 3. In this way, when the cartridge chamber is again moved forwardly, it will accurately pick up the new cartridge.

During the first portion of the forward movement of the cartridge chamber, the flat springs 17*a* and 17*b* are urged, by the prolongations 17 to which they are fixed, onto the flattened sides of the rear end 2*a* of the barrel 2. Such springs therefore position themselves flat in the free spaces 17*d* present between the prolongations 17 and the barrel 2. As the cartridge chamber 3 continues to move onto the cartridge held by the springs, the latter will be cammed radially outwardly, so that the springs finally release the cartridge completely when the cartridge chamber 3 has been pushed far enough onto the cartridge to prevent the same from tilting.

Figure 4:
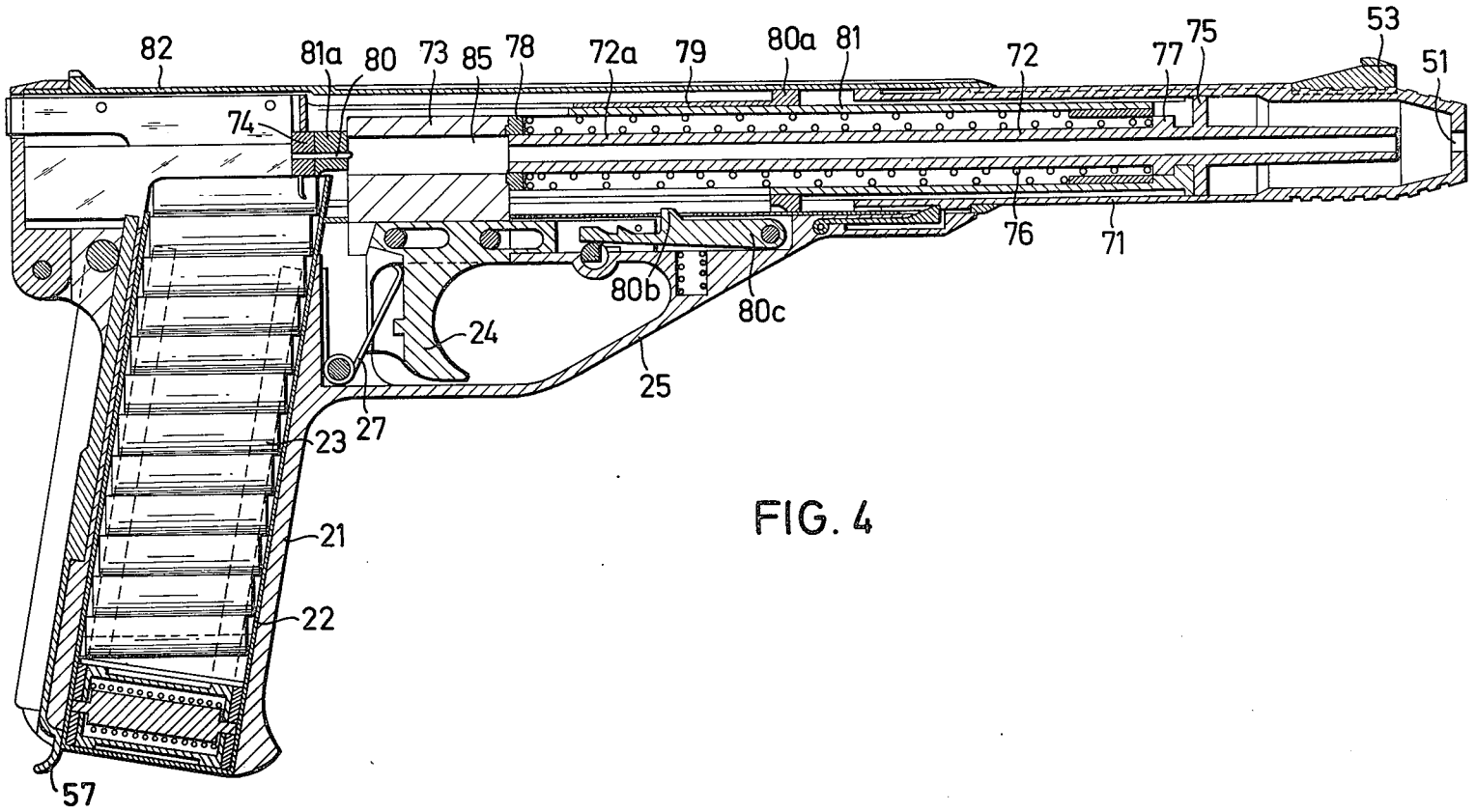
FIG. 4 is a longitudinal section, similar to that of FIG. 1, through a second embodiment of the invention.

The embodiment shown in FIG. 4 differs from that shown in FIG. 1 principally in that a barrel 72 is displaceably mounted in a tubular front part 71 of a two-part housing while an associated cartridge chamber 73 remains stationary. The barrel 72 is provided with a collar 75 displaceable as a piston in the housing 71. A helical biasing spring 76 rests at one end against a collar 77 of the barrel 72, while its other end engages a disc 78 serving as a fixed support on the front end of the cartridge chamber 73.

A striker pin holder 74 which bears the striker 80 is fixed to the rear end of a partly slotted tube 79. The tube 79 is axially displaceable on a second partly slotted tube 81. The front end of the tube 81 engages and closes behind the collar 77 and the barrel 72. The tube 81 has an abutment 81*a* disposed behind the cartridge chamber 73 and through which the striker 80 movably extends. As in FIG. 1, the barrel 72 which is situated in front of the cartridge chamber 73 when the chamber is in its closed-breech position, and the associated abutment, which is situated behind such chamber in such position, are rigidly interconnected and thus synchronously displaceable in relation to the fixed cartridge chamber 73.

Upon the firing of the projectile, the force of the gases emerging from the front end of the barrel and acting on the collar 75 propels the barrel 72 rearwardly against the force of the spring 76. The rear end 72*a* of the barrel thereupon penetrates the centrally situated bore 85 of the cartridge chamber 73, and expels the spent cartridge casing from the rear end thereof. Since the abutment 81*a* and the striker holder 74 are secured to the barrel 72, they are thrust back together with the barrel 72 by the gases and therefore do not impede the explusion of the cartridge. The expelled spent cartridge casing is ejected from the weapon through an aperture (not shown) on the forward movement of the abutment 81*a* when the magazine feeds in the next fresh cartridge.

The abutment 81*a*, when moved by the helical spring 76 into the front or closed-breech position shown in FIG. 4, pushes the cartridge 23 ejected from the magazine into the bore 85 of the cartridge chamber 73, so that this cartridge can now be fired.

The tube 80 bearing the striker holder 74 is provided at its front end with a collar 80*a* which, on the movement of the barrel to the open-breech position, comes to rest behind a lug 80*b* of a lever 80*c* pivotally mounted in the fixed part 82 of the housing. The collar 80*a* is not released again until after the trigger 24 has been pressed.

Since in the arrangement of FIG. 4 the movable housing part 71 is movable axially into the fixed housing part 82 of the firearm, the weapon is relatively short axially when in the inoperative position. When the weapon is to be used, the barrel 72 and the housing part 71 are first moved into their extended position, e.g. by pressing the trigger 24.

Figure 5:
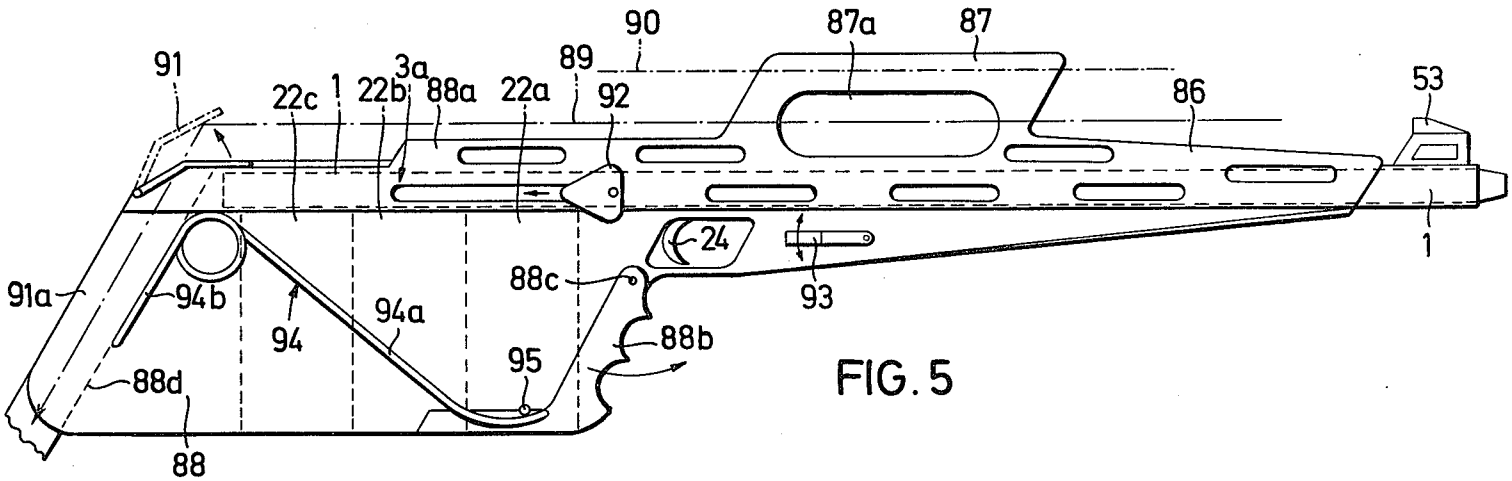
FIG. 5 is a longitudinal view through an additional embodiment of the invention.

FIG. 5 shows diagrammatically another embodiment of the invention in the form of a rifle. The barrel and the firing mechanism are similarly constructed to the examples shown in FIGS. 1 and 4. The rifle of FIG. 5 has a stock 86, a handle 87 and a butt 88. The upper part of the handle 87 contains a sighting telescope whose optical axis is situated above an optical axis 89 leading to the front sight 53. For indirect sighting via the front sight 53, a mirror 91 is provided. The mirror which can be moved upwardly on a hinge, is situated above an optical channel 91*a* in the rear end of the butt 88 and has a built-in periscope system. The side of the rifle is fitted with a thumb rest 92 which can be pulled back as an aid in loading the rifle. A safety lever 93 is provided on the rifle stock.

On the top of the rifle is an attachment 88*a* which extends forwardly from the zone of the firing chamber of the weapon and which can accommodate an ejection channel for spent cartridge casings. The attachment 88*a* extends as far as the aperture 87*a* of the handle, where the spent cartridge casings can be ejected.

In the weapon shown in FIG. 5, the cartridge-containing firing chamber 3*a* is situated near the rear end of the butt 88. The butt 88 contains three magazines 22*a*, 22*b* and 22*c* which are successively situated, with the magazine farthest to the right in FIG. 5 being the one from which cartridges are taken in the case of repeated fire. The magazines can be inserted in the hollow butt 88 when a grip 88*b* pivotally mounted on its front end is swung forwardly about a joint pin 88*c*.

Two springs 94 are affixed to the interior of the hollow butt 88. A longer spring leg 94*a* of each spring 94 extends as far as the front magazine 22*a*, and engages a pin 95 which penetrates to the outside of the magazine and is connected with the slide accommodated therein. As a result, the springs 94 acting on both sides of the magazine 22*a* urges the ammunition present in the latter upwardly. Another leg 94*b* of each of the two springs 94 rests against rear wall 88*d* of the hollow butt 88.

FIG. 5 also shows that the front magazine 22*a* is situated, as viewed in the firing direction, in front of the firing chamber 3*a*. This arrangement offers the advantage that the cartridges can be ejected from the magazine on the return movement of the cartridge chamber so that the return trajectory for the cartridge chamber and thus the time required for repeated fire can be shortened.

If the magazine 22*a* is empty, it is ejected from the butt 88 by opening the grip 88*b*. A spring-loaded slide (not shown) accommodated in the rear part of the butt 88 is adapted to push forwardly the other two magazines 22*b* and 22*c* situated in the butt, whereby the magazine 22*b* now occupies the front position and cartridges can be taken from it during repeated fire.

The weapon construction covered by the invention is light and short, has a very high firing rate due to the moderate weights of the movable parts having to be moved and the relatively short distances over which the movable parts have to be reciprocated, and is suitable for military security and sporting purposes. Additionally, it can be adapted to apparatus of very small calibre.

Figure 6:
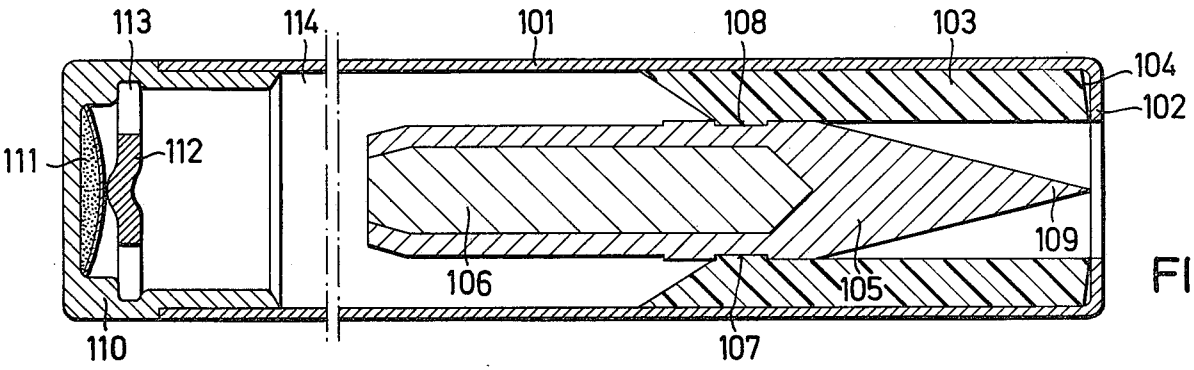
FIG. 6 is an enlarged longitudinal section through a cartridge suitable for use in firearms constructed in accordance with the invention.

The cartridge shown in FIG. 6 has a thin-walled tubular casing 101, illustratively of brass or steel. The front end of the casing 101 is bent over to form a flange 102 which extends inwardly. When the cartridge is fired, the flange is pressed against the rear end of the barrel of the weapon to produce a desirable sealing effect.

The front end of the casing is provided with a bushing 103, which may be formed from a synthetic plastic such as polyamide. The bushing 103 of the casing has a slightly inwardly tapering end surface 104, so that when the cartridge is fired, the flange 102, which is initially radial to the outer surface of the casing 101, is pressed outwardly into a correspondingly conical shape and thus bears with a hermetic effect against the rear end of the barrel.

The bushing 103 serves to secure a projectile 105 in the casing 101. The projectile may consist of a tubular copper sheath and a solid core 106, illustratively of steel. The projectile 105 is provided with a flat annular groove 107 into which extends a corresponding annular projection 108 of the bushing 103. Preferably, the projectile 105 is held by the bushing 103 in such a position that a tip 109 thereof does not extend from the cartridge case. The soft copper sheath of the projectile presses itself into the rifling of the barrel of the weapon, while the steel core 106 provides the required penetrating power.

A percussion cap 110 is inserted in the rear end of the tubular casing 101. This cap contains a detonating composition 111 and a disc-shaped anvil 112 which is inserted above it. The anvil 112 has a number of sector-shaped recesses 113 through which the detonation flame can penetrate a cavity 114 which is to be filled with powder.

The cartridge case of FIG. 6 can be economically manufactured since it consists mainly of a tubular piece and of a percussion cap which is inserted therein. The cartridge requires no particular wall reinforcements since, when being fired, it is intercepted in the weapon over its entire surface and needs no extraction groove.

In the foregoing, the invention has been described in connection with several embodiments thereof. Many variations and modifications will now occur to those skilled in the art. It is accordingly desired that the scope of the appended claims not be limited to the specific disclosure herein contained.

What is claimed is:

1. In a cartridge for firearms comprising, in combination, a hollow elongated cartridge case having a thin tubular wall, percussion means disposed at the rear end of the case, a projectile, and a bushing engageable with the inner wall of the case for supporting the projectile entirely within the case forwardly of the percussion means, the improvement wherein the front surface of the cap is bent radially inwardly to form an integral flange, and in which the front end of the bushing exhibits an inwardly and forwardly extending taper, the bushing being positioned in a forward portion of the case with the forward end of the taper abutting the radially inwardly bent flange of the case.

2. A cartridge as defined in claim 1, in which a rear portion of the forwardly positioned bushing exhibits an annular projection, and in which the portion of the projectile radially aligned with the projection exhibits a mating annular recess for receiving the annular projection on the bushing.

* * * * *